United States Patent [19]

Iwamura et al.

[11] Patent Number: 5,037,471

[45] Date of Patent: Aug. 6, 1991

[54] METHOD FOR MANUFACTURING OXYGEN-FREE COPPER

[75] Inventors: Takuro Iwamura; Tsugio Koya, both of Saitama; Izumi Sukekawa, Tokyo; Hideru Hagiwara, Tokyo; Haruhiko Asao, Tokyo; Toshiaki Shigematsu, Tokyo; Hideki Sato, Osaka, all of Japan

[73] Assignee: Mitsubishi Metal Corporation, Tokyo, Japan

[21] Appl. No.: 439,936

[22] Filed: Nov. 21, 1989

[30] Foreign Application Priority Data

Nov. 21, 1988 [JP] Japan ..... 63-294179

[51] Int. Cl.[5] ..... C22B 15/14

[52] U.S. Cl. ..... 75/648

[58] Field of Search ..... 75/648

[56] References Cited

U.S. PATENT DOCUMENTS 3,607,231 9/1971 Hart .
3,987,224 10/1976 Brinkmann et al. ..... 75/648
4,462,845 7/1984 Klar et al. .

FOREIGN PATENT DOCUMENTS 47-3683 2/1972 Japan .
64617 6/1978 Japan ..... 75/648
1071127 6/1967 United Kingdom .
1146082 3/1969 United Kingdom .
1160984 8/1969 United Kingdom .
1204565 9/1970 United Kingdom ..... 75/648

OTHER PUBLICATIONS

A. R. Baker et al., "Deoxidation of Molten Copper by an Impringing Jet of Reducing Gas", 1983, pp. C179–C186, Trans. Inst. Min. Metall. C92.

*Primary Examiner*—Melvyn J. Andrews
*Attorney, Agent, or Firm*—Oblon, Spivak, McClelland, Maier & Neustadt

[57] ABSTRACT

Method and apparatus for manufacturing an oxygen-free copper having an oxygen content of no greater than 3 ppm by weight are disclosed. In the method, a deoxidizing step is carried out by bringing a reducing gas containing hydrogen gas into contact with a molten copper to react to the oxygen to remove the same. Then a dehydrogenation step may be carried out by bringing a gas of lean hydrogen concentration into contact with the molten copper. Accordingly, the apparatus has a deoxidizing device for blowing the reducing gas into the molten copper and preferably a dehydrogenation device.

7 Claims, 4 Drawing Sheets

METHOD FOR MANUFACTURING OXYGEN-FREE COPPER

BACKGROUND OF THE INVENTION

1. Field of the Invention

The present invention pertains to a method and apparatus for manufacturing an oxygen-free copper which is suitably used as a material for the electrodes of electron tubes.

2. Prior Art

When copper is melted under ambient conditions, several tens to several thousands parts per million by weight of oxygen is dissolved, and this oxygen remains when the copper returns to the solid state. Such dissolved oxygen causes a so-called hydrogen embrittlement, which results in a lowering of hot-workability and blistering during annealing. This is because hydrogen in the atmosphere diffuses into and through the copper to react with the oxygen dissolved in the copper to produce water vapor, which results in internal defects or surface discontinuities causing blistering.

Furthermore, when some alloying elements are added to copper containing no less than 10 ppm by weight of oxygen, the oxygen reacts with the alloying elements to produce non-metal inclusions of oxides, which give rise to microscopic defects, detracting from the characteristics of the alloy itself. In addition, since gaseous discharge from the metal is increased, the copper becomes unsuitable as a material for vacuum vessels or electron tubes. Thus, the oxygen in metals has deleterious effects, and hence it is necessary to keep the oxygen content as low as possible when melting copper.

Hitherto known methods for the deoxidization of molten copper are as follows:

(1) the method of adding a small amount of a deoxidizing element such as phosphorus (P) to the molten copper;

(2) the method of coating the molten copper with a carbonaceous coating material such as charcoal;

(3) the method of melting the copper under an atmosphere of a reducing sealing gas such as that of carbon monoxide (CO) gas; and (4) the method of vaporizing out the dissolved oxygen by melting the copper in a vacuum.

The above methods, however, have the following disadvantages.

In method (1), since the element added as the deoxidizer and the resulting oxide remain in the molten copper and have an adverse effect on the characteristics of the copper, time and labor is required to remove them. In addition, it is very difficult to reduce the oxygen content to less than 10 ppm by weight by this method.

In method (2) in which the oxygen is caused to react with the coating, if the coating is damaged, oxygen is immediately absorbed into the copper, with detrimental effects. Also with this method it is difficult to reduce the oxygen content to less than 5 ppm by weight.

Method (3) has been extensively used on an industrial scale for producing oxygen-free copper containing no greater than 10 ppm by weight of oxygen. This method exhibits a superior deoxidizing performance and makes use of the following deoxidization reaction:

$$CO + [0] \text{ in molten Cu} \rightarrow CO_2$$

However, since the reaction rate is determined by the diffusion of oxygen in the copper, it is slow and hence a long processing time is required. Therefore, a holding furnace of a large volume must be located between the melting furnace and the casting machine, increasing installation and operation costs unduly. Furthermore, inasmuch as the reaction rate is slow, the oxygen removed to the ambient atmosphere and to the containing vessel is absorbed back into the copper to some extent when the oxygen content is reduced, making it difficult to reduce the oxygen content below 3 ppm by weight.

Moreover, in method (4) involving melting under a vacuum, deoxidization is effected according to the following reaction:

$$2[0] \rightarrow O_2$$

In order to reduce the oxygen content below 3 ppm by weight according to this reaction, a high degree of vacuum in the vessel is necessary, and hence a substantial apparatus is required. In addition, since the reaction rate itself is slow, a long processing time is required, thereby significantly increasing manufacturing cost. Furthermore, this process is basically of a batch type and is not applicable to a continuous casting process utilizing a continuous casting machine.

SUMMARY OF THE INVENTION

It is therefore an object of the present invention to provide a method for manufacturing an oxygen-free copper with an oxygen content sufficiently reduced so that it can be used even for applications with highly stringent quality requirements such as in the case with materials for electron tubes, and which is amenable to rapid and continuous manufacture of such oxygen-free copper at a reduced manufacturing cost.

Another object of the invention is to provide a manufacturing apparatus suitably adapted for implementing the aforesaid manufacturing method.

According to a first aspect of the present invention, there is provided a method for manufacturing an oxygen-free copper characterized by the step of bringing a reducing gas containing hydrogen into contact with molten copper to react with any oxygen contained therein. It has hitherto been known that although hydrogen has a strong deoxidizing effect, it causes hydrogen embrittlement when it coexists with oxygen, thereby deteriorating the quality and characteristics of ingots. Therefore, the use of hydrogen for deoxidization processing has not been contemplated. However, the inventors have found that since hydrogen has a high diffusion rate and hence a large deoxidization capacity, its reaction products can be easily removed as water vapor, and as a result have succeeded in utilizing hydrogen for deoxidization processing.

According to a second aspect of the invention, there is provided a manufacturing apparatus designed to carry out the above manufacturing method. The apparatus comprises a melting furnace for melting a copper material and a deoxidizing device for blowing a reducing gas containing hydrogen into the molten copper to react with any oxygen dissolved in the molten copper, thereby removing the oxygen. The apparatus may further comprise a dehydrogenating device for exposing the molten copper to a gas of low hydrogen content to remove the residual hydrogen in the molten copper.

DETAILED DESCRIPTION OF THE INVENTION

Figure 1:
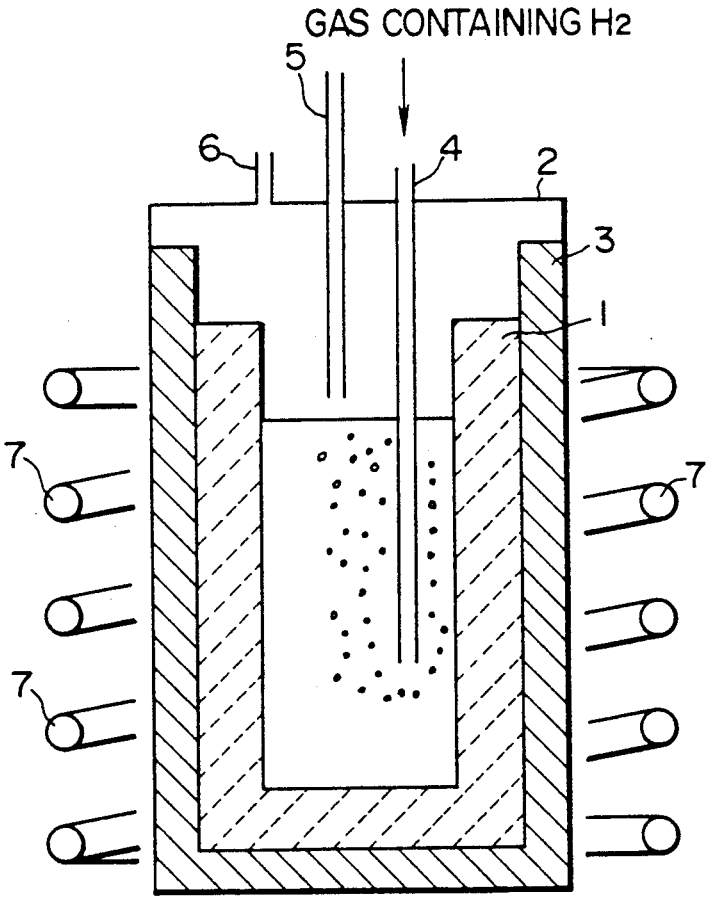
FIG. 1 is a schematic cross-sectional view of an apparatus for manufacturing an oxygen-free copper in accordance with a first embodiment of the invention.

A method for manufacturing an oxygen-free copper in accordance with the present invention is characterized by the step of bringing a reducing gas containing hydrogen into contact with a molten copper to react with the oxygen therein. When necessary, hydrogen remaining in the molten copper is removed after the oxygen is removed therefrom.

The reducing gas, which contains hydrogen, may be applied only to the surface of the molten copper, however it is preferably blown into the molten copper to ensure an efficient reaction.

The composition of the reducing gas should be determined taking various aspects into account, but is preferably comprised of a reducing component and an inert component, with the hydrogen content in a range from 0.5% by volume to 50% by volume. In a case where 50 Kg of molten copper, for example, is to be deoxidized, if the hydrogen content in the reducing gas is less than 0.5% by volume, the method is impractical since it can take more than one hour to reduce the oxygen content from 10 ppm by weight to 3 ppm by weight. On the other hand, if the hydrogen content is about 50% by volume, the processing time is reduced to as short as 10 minutes. However, increasing the hydrogen content above 50% by volume has no further effect on the processing time, and the reaction efficiency is lowered. In addition, a high hydrogen content is impractical due to the danger of explosion during handling.

Carbon monoxide is preferably used as the reducing component of the reducing gas since it lowers the equilibrium value of oxygen and reduces the $H_2O$ produced by the oxidation of hydrogen, to form hydrogen which can again contribute to the reduction.

An apparatus of the invention designed to carry out the aforesaid manufacturing method on a commercial scale comprises a melting furnace for melting a copper material and a deoxidizing device for blowing a reducing gas containing hydrogen into the molten copper to react with any oxygen dissolved in the molten copper to remove the same. A dehydrogenating device for exposing the molten copper to a gas lean in hydrogen to remove the residual hydrogen in the molten copper may be further provided, and a continuous casting device for casting the molten copper thus dehydrogenated is generally combined with the aforesaid devices for the continuous manufacture of an oxygen-free copper on a commercial scale.

All of the aforesaid devices are usually constructed so as to be hermetically sealable from the ambient air, and adjacent devices are connected to each other by respective hermetically sealable passages interposed therebetween. The resulting sealed spaces in the devices and passages are filled with a sealing gas to prevent the oxidation of the molten copper. When there is a possibility of flow of gases between adjacent devices, the downstream device should be designed to have a higher pressure than the upstream device, in order to prevent water produced in the deoxidizing device from being absorbed at the downstream device. Alternatively, a gate having an opening at its lower end may be arranged at a passage of the molten copper, to shut off the upper space in the passage to thereby prevent gas from flowing downstream.

The deoxidizing device for removing the oxygen in the molten copper comprises a container having an inlet for molten copper at one end, an outlet for the same at the other end, and a nozzle mounted in the bottom of the container for blowing the reducing gas containing hydrogen into the molten copper.

The dehydrogenating device for removing the residual hydrogen in the molten copper may be a device wherein the molten copper is introduced into a launder to produce a shallow flow, and is exposed to a reducing gas or inert gas free of hydrogen to absorb the hydrogen, or may be a device wherein the molten copper is agitated by bubbling of a gas as described above to improve the removability.

In the method in accordance with the present invention, the following reaction will occur in the molten copper:

$$2H + O \rightarrow H_2O$$

In this reaction, since the diffusion rate of hydrogen in the molten copper is high, the equilibrium state as defined by the following equation is quickly arrived at.

$$[\%H] = K\sqrt{p(H_2O)/[\%O]}$$

wherein [%H], [%O], $p(H_2O)$ and K denote hydrogen concentration, oxygen concentration, partial pressure of $H_2O$ and equilibrium coefficient, respectively.

Accordingly, even though [O]content is extremely low, e.g. below 3 ppm by weight, deoxidization can be effected at a rate higher than the rate at which the oxygen returns into the copper from the ambient atmosphere or reactor vessel.

The reason why the deoxidization reaction is thus high in the case where hydrogen gas is used will be explained in comparison with the use of carbon monoxide gas. Hydrogen gas is dissociated into atomic hydrogen and quickly diffuses into the molten copper to react with oxygen to produce $H_2O$. On the other hand, carbon monoxide gas does not dissolve in the molten copper at all. Therefore, the chemical reaction with oxygen proceeds only on the surface of the molten copper, so that the deoxidization rate is limited.

The provision of the gas-blowing nozzle enables a bubbling process to be used which involves blowing the reducing gas into the molten copper. Therefore, the contact surface area between the gas and the molten copper is increased substantially so that an efficient reaction and a high reaction rate can be achieved.

As the reaction proceeds, the $H_2O$ concentration within the bubbles increases and the $H_2$ concentration therein decreases, so that the deoxidization ability decreases. However, when CO gas is contained in the reducing gas which is blown from the nozzle, the $H_2O$ gas and CO gas react with each other as follows:

$$H_2O + CO \rightarrow H_2 + CO_2$$

Thus the $H_2$ concentration will increase again and the deoxidization ability can be maintained at a high level.

The concentration of the hydrogen remaining in the molten copper has a correlation with a partial pressure of hydrogen in the ambient atmosphere surrounding the molten copper as shown in the following formula:

$$[\%H] = K\sqrt{p(H_2)}$$

where $p(H_2)$ is the partial pressure of hydrogen.

Thus, if the partial pressure of hydrogen in the ambient atmosphere is decreased, the hydrogen concentration in the molten copper will be reduced. Accordingly, keeping the ambient atmosphere surrounding the molten copper in a state in which hydrogen concentration is low results in a rapid removal of hydrogen from the copper.

FIG. 1 depicts a pilot deoxidizing device for evaluation of the deoxidization method of the present invention. The apparatus comprises a crucible 1 of a refractory material such as graphite for holding the molten copper therein, a cover 2 for closing the crucible 1, and an outer shell 3 disposed so as to surround the crucible 1. A lance pipe 4 for blowing the gas into the molten copper and a samplesuction pipe 5 for drawing up a specimen of molten copper are inserted through the cover 2 into the crucible, and an exhaust pipe 6 for discharging the gas within the crucible 1 is secured to the cover. A heater 7, which serves as a heating source for the melting and heat-treatment operations, is designed so that 30 Kg to 50 Kg of copper can be melted in the crucible 1. In the foregoing, the gas blown by the lance pipe 4 into the lower portion in the crucible 1 moves upwards within the molten copper while reacting therewith, and is drawn out by a suction apparatus (not shown) through the exhaust pipe 6 and discharged.

Table 1 shows data on oxygen concentration for reducing gases of various compositions when the copper was subjected to deoxidization using the aforesaid deoxidization device. In the example, the dew points of all of the reducing gases were no greater than −70° C., and the melting temperature and the oxygen concentration for the copper material was 1200° C. and 10 ppm by weight, respectively. The amount of the molten copper in the crucible 1 was kept constant.

TABLE 1

| Composition of gas blown | Oxygen concentration (ppm) After 10 minutes processing | After 20 minutes processing |
|---|---|---|
| CO | 7 | 5 |
| 5% $H_2$ + Ar | 3 | 2 |
| 5% $H_2$ + CO | 2 | 2–1 |
| 20% $H_2$ + CO | 2–1 | 1.5–0.8 |
| 50% $H_2$ + CO | 2–1 | 1.3–0.7 |
| 5% $H_2$ + $N_2$ | 3 | 2 |

As can be seen from the results, for the case of a reducing gas mixture of $H_2$ and Ar with 5% by volume of $H_2$, the oxygen concentration is reduced to 2 ppm by weight after 20 minutes processing. If CO gas is utilized instead of Ar gas, the oxygen concentration is further reduced to less than 2 ppm by weight after the processing for the same period. If the $H_2$ concentration is increased to 20% by volume, the oxygen concentration can be reduced to about 1 ppm by weight. This is due to the combined effect of $H_2$ gas and CO gas.

The dehydrogenation was carried out by blowing Ar gas into the molten copper after the aforesaid processing. Although the hydrogen concentration was 1.44 ppm by weight after 20 minutes processing using a 5% $H_2$ gas and Ar gas mixture, it was reduced to 0.36 ppm by weight after the blowing of Ar gas for 20 minutes, and the oxygen concentration showed no sign of increase after such processing.

Figure 2:
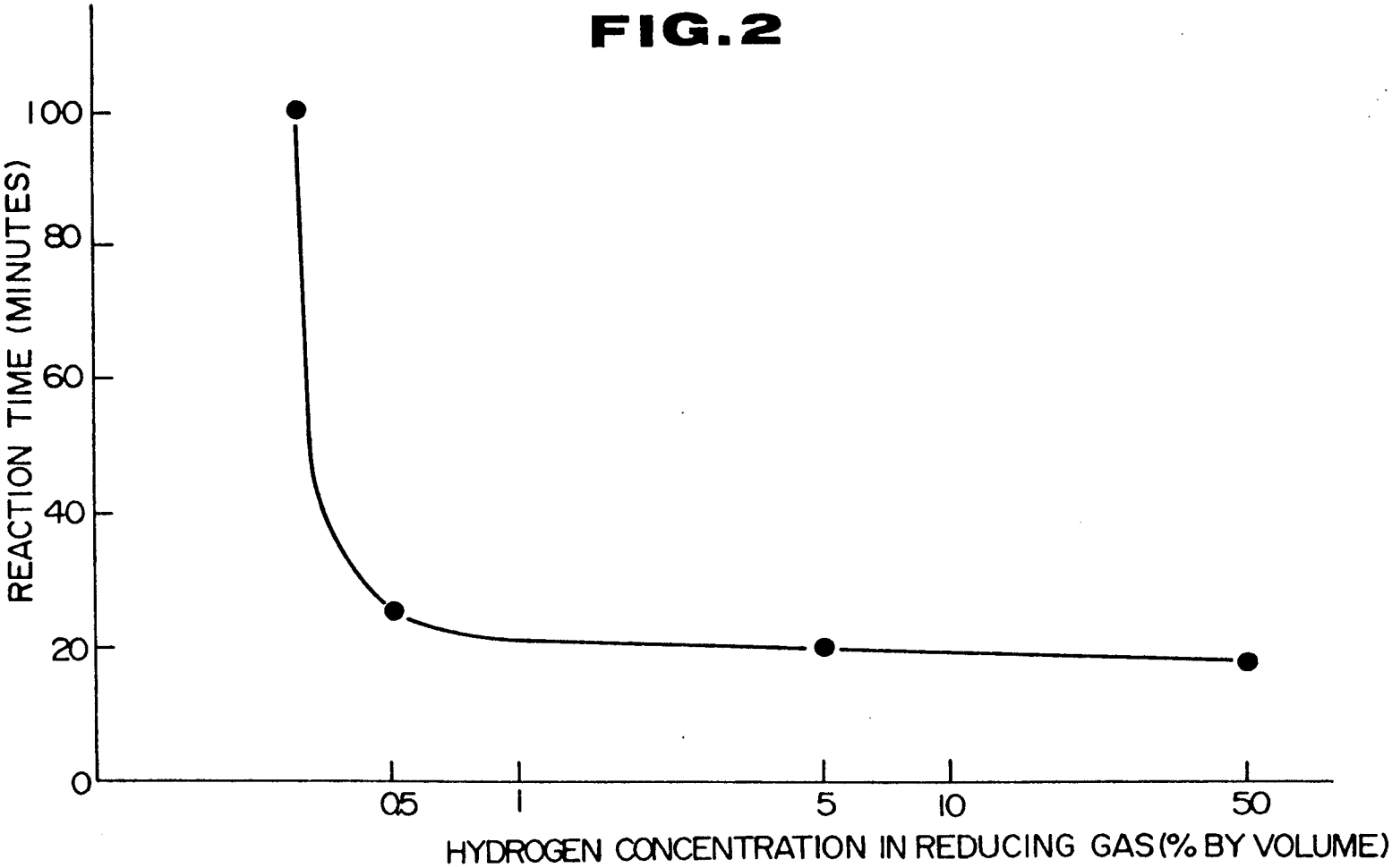
FIG. 2 is a graph showing a relationship between the hydrogen content of a reducing gas and a reaction rate.

FIG. 2 depicts the time required to arrive at an oxygen concentration of 2 ppm by weight plotted against various hydrogen concentrations in the reducing gas mixture of $H_2$ and Ar. As will be seen from this result, the reaction time is very long when the hydrogen concentration is less than 0.5% by volume, resulting in high energy costs for the heat-treatment of the molten copper as well as high operating costs. On the other hand, if the hydrogen concentration exceeds 50% by volume, the reaction efficiency of the hydrogen becomes extremely low and energy costs are again increased.

Figure 3:
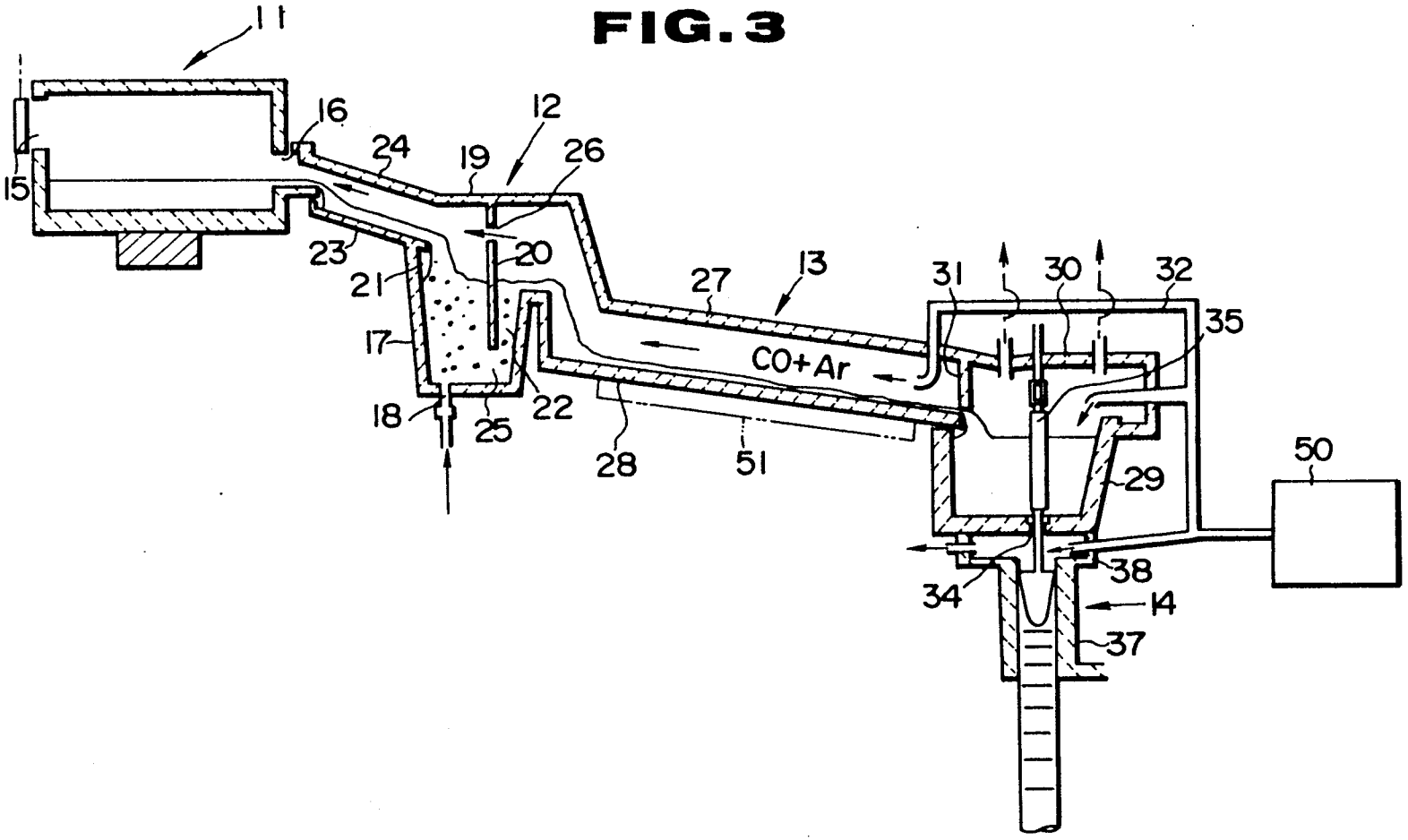
FIG. 3 is a schematic cross-sectional view showing an apparatus for manufacturing an oxygen-free copper in accordance with a second embodiment of the invention.

FIG. 3 depicts a manufacturing apparatus in accordance with a further embodiment of the invention which is designed for use on an industrial scale. The apparatus comprises a melting furnace 11 for melting a solid copper material, a deoxidizing device 12 for blowing the reducing gas into the molten copper to remove the oxygen in the molten copper, a dehydrogenating device 13 for removing hydrogen remaining in the molten copper, and a continuous casting machine 14 for continuously casting the molten copper.

The deoxidizing device 12 includes a container 17 for holding the molten copper and a nozzle 18 mounted thereto for blowing the reducing gas into the container from the bottom of the container. The container 17 is covered with a cover 19 so that a sealed space is formed therein. The inside of the container 17 is divided into an upstream bubbling chamber 21 and a downstream up-flow chamber 22 by a gate 20 which extends vertically from the cover 19. The nozzle 18 is mounted in the bottom of the bubbling chamber 21. The container 17 is connected to an outlet 16 of the melting furnace 11 through a first launder 23, which is also covered by an upper plate 24 to define a sealed space therein. An opening 25 is formed under the partition gate 20 to allow the molten copper to flow therethrough, and an aperture is formed through the upper part of the partition gate 20 to define a gas passage 26 for the flow of a sealing gas therethrough.

A second launder 28, covered with a cover 27 to define a sealed space therein, is communicated at one end with the outlet of the up-flow chamber 22 and at the other end with a tundish 29 which is disposed above the continuous casting machine 14. The tundish 29 has a pouring hole 34 formed in the bottom, and a stopper 35 releasably fitted into the hole so that it can open and close the hole 34. The tundish 29 is also covered with a cover 30 to define a sealed space therein. The second launder 28 is inclined at an angle less than that of the first launder 23 and is greater in length. The cover 27 of the launder 28 is connected at one end to the cover 19 of the container 17 and at the other end to the cover 30 of the tundish 29. A wall 31 is formed at the end of the cover 27 connected to the tundish 29 having an opening at its lower end so as to prevent gas from flowing between the tundish 29 and the second launder 28. In addition, a cylindrical wall 38 is interposed between the tundish 29 and a mold 37 of the continuous casting machine 14.

Several pipes 32, which branch off from a main pipe connected to a source 50 of reducing gas or inert gas, are connected at their other ends to the downstream end of the second launder 28, the tundish 29 and the cylindrical wall 38, respectively. Thus, gas for sealing and removing hydrogen can be introduced into the respective devices through the above-mentioned pipes 32. In the foregoing, the second launder 28 to which one of the pipes 32 is connected constitutes the dehydrogenation device 13.

In the apparatus, the molten copper in the melting furnace 11 is tapped from the outlet 16 through the first launder 23 into the bubbling chamber 21 of the deoxidizing device 12. In the bubbling chamber 21, a reducing gas containing 5% by volume of $H_2$ and 95% by volume of CO gas is blown from the nozzle 18 thereinto, and moves upwards while expanding in volume, to thereby agitate the molten copper in the bubbling chamber 21. Hydrogen in the reducing gas is dissociated as atomic hydrogen at the interface with the copper, and dissolves in the molten copper to react with oxygen therein to produce $H_2O$. This $H_2O$ is combined with and absorbed into the bubbles, and reacts with CO gas in the bubbles to produce $H_2$ and $CO_2$. The $H_2$ thus produced dissolves with the molten copper and further contributes to the deoxidization reaction. Accordingly, if the depth of the molten copper in the bubbling chamber 21 is comparatively great, a high reaction rate and an improved reaction efficiency can be ensured.

An ambient gas as will be described later is introduced into the launder 28 from its downstream end, so that the pressure at the downstream side with respect to the partition gate 20 is higher than the pressure at the upstream side. Therefore, the gas flow through the gas passage 26 is restricted to that in the direction from the downstream side toward the upstream side, so that the reducing gas rich in $H_2O$ and flowing up from the molten copper is carried with the gas flow through the first launder 23 into the melting furnace 11 and out through an opening 15 of the furnace.

As the molten copper flows from the bubbling chamber 21 through the opening 25 under the partition gate 20 into the downstream up-flow chamber 22, the gaseous components such as hydrogen and water vapor dissolved therein are removed. The molten copper then overflows the container 17 into the second launder 28, where the flow of molten copper is shallower compared to the depth in the first launder 23 since the second launder 28 is greater in width and length and has a gentler inclination angle. An ambient gas, comprised of a mixture of a reducing gas excluding hydrogen such as CO gas and an inert gas such as argon gas, is introduced through the pipe 32 into the upper space in the second launder 28, and flows from the downstream side to the upstream side, while absorbing hydrogen from the molten copper thereby removing it. The ambient gas then flows from the second launder 28 into the deoxidizing device 12 as described above, and flows through the gas passage 26 in the partition gate 20 into the upper space of the bubbling chamber 21. In the bubbling chamber 21, the ambient gas combines with the reducing gas bubbling up in the chamber after the deoxidization reaction and the gases flow through the first launder 23 to cover the surface of the melt in the melting furnace 11.

As described above, in the manufacturing apparatus of FIG. 3, the melting furnace 11, the deoxidizing device 12 and dehydrogenation device 13 are hermetically sealably connected to each other by means of launders 23 and 28, and the ambient gas is introduced from the downstream dehydrogenation device 13 to absorb the hydrogen and to seal the molten copper. The gas in the up-flow chamber 22 of the deoxidizing device 12 contains water which is a reaction product, and the amount of the ambient gas to be introduced from the pipe 32 into the dehydrogenation device 13 is regulated so that the downstream side has a higher pressure than the upstream side. Furthermore, inasmuch as leaks might occur between connecting portions in the aforesaid manufacturing apparatus, the flow rate of the ambient gas should be determined so as to compensate for any leakage of gas through the leaks and to maintain the inside of the apparatus to a pressure higher than the outside.

In the second launder 28, since the flow of the molten copper is relatively slow, its temperature tends to decrease. Therefore, a means to compensate for the decrease of temperature such as a heating device 51 may be provided.

The molten copper that has completed the dehydrogenation step flows from the lower end of the second launder 28 into the tundish 29, and is introduced into the mold 37 under regulation involving opening and closing of the stopper 35. The inside of the tundish 29 and the inside of the cylindrical wall 38 between the tundish 29 and the mold 37 are filled with the ambient gas, so that sealing of the molten copper and removal of hydrogen from the molten copper is also carried out at these places.

Figure 4:
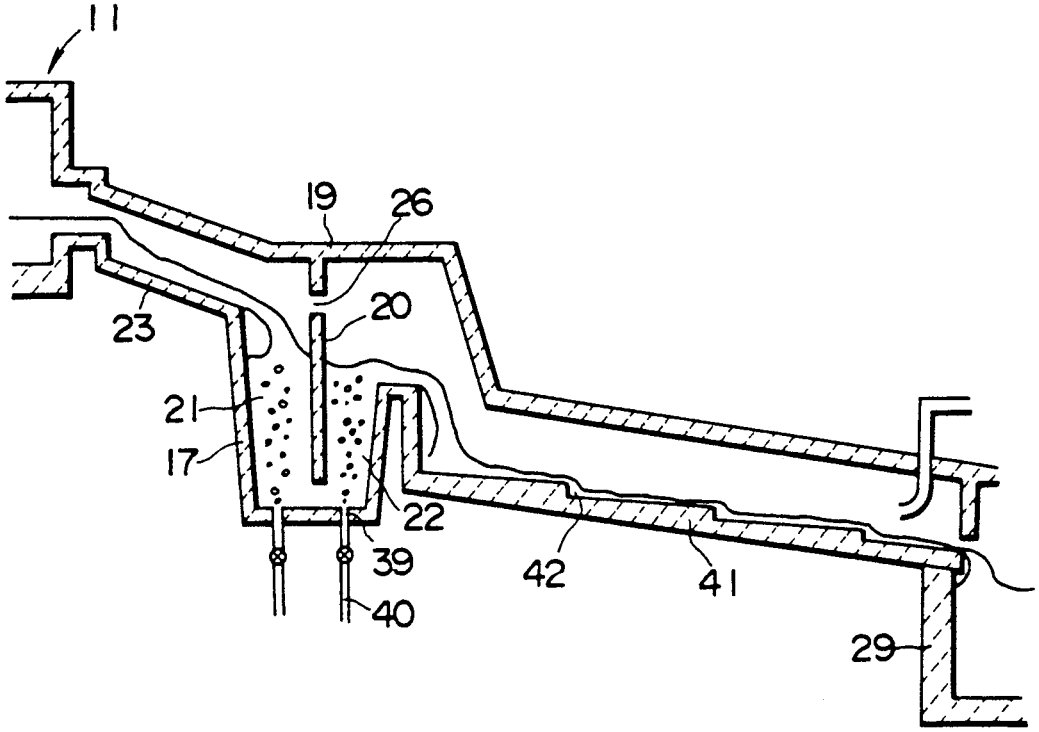
FIG. 4 is a view similar to FIG. 3, but showing an apparatus in accordance with a third embodiment of the invention.

FIG. 4 depicts a further modified apparatus in accordance with the present invention, which includes an additional gas blowing nozzle 39 mounted in the bottom of the upflow chamber 22 of the deoxidizing device 12, enabling an ambient gas having the same composition as in the aforesaid ambient gas to be introduced from a pipe 40 through the nozzle 39 into the up-flow chamber 22. This ambient gas serves to agitate the molten copper in the up-flow chamber 22 and facilitate the up-flow, absorption and removal of the hydrogen in the molten copper. Furthermore, in the illustrated embodiment, the dehydrogenation device includes a second launder 41 having several stepped portions 42 formed at the bottom thereof and spaced from each other along the longitudinal length. With this construction, the flow of the molten copper is disturbed at each stepped portion thereby increasing the contact surface area between the ambient gas and the molten copper to facilitate the removal of hydrogen.

As described above, in the present invention, since a reducing gas containing hydrogen is brought into contact with the molten copper to react with the oxygen therein to remove it, the rate of deoxidization of the molten copper is high and the oxygen concentration arrives at an equilibrium value very rapidly. Therefore, oxygen-free copper of less than 3 ppm by weight of oxygen content, which cannot be manufactured by any prior art methods, can be positively manufactured, and hence material suitable for electron tubes and vacuum vessels with a high degree of vacuum can be obtained. Furthermore, inasmuch as the deoxidization can be carried out in a short time in a very effective way, device requirement for heat is decreased and the operation efficiency of the installation can be improved, so that a large amount of oxygen-free copper can be manufactured at a reduced manufacturing cost.

In addition, the reaction efficiency can be enhanced by blowing the reducing gas into the molten copper to increase reaction surfaces. Furthermore, by combining the steps of exposing the molten copper to an inert gas with low hydrogen partial pressure and of blowing the reducing gas into the molten copper, the hydrogen remaining in the molten copper can be removed almost completely, so that ingots of a good quality having less oxygen and hydrogen can be obtained.

Moreover, the reaction time to achieve a prescribed oxygen content and the reaction efficiency of hydrogen gas can be regulated to desired values, respectively, by adjusting the hydrogen content of the reducing gas from 0.5% by volume to 50% by volume, so that stable operation as well as a reduction in cost can be attained.

In addition, $H_2O$ gas produced by the reaction of the reducing gas with oxygen can be reduced into hydrogen gas by including CO gas as a component of the reducing gas, and therefore the rate of deoxidization can be increased substantially. The contact reaction with the reducing gas as described above can be carried out continuously even while the molten copper is flowing. Therefore, simplification of the installation and the sealing structure for the molten copper as well as improvements of device requirements for heating and operation efficiency can be achieved by connecting the dehydrogenation device to other devices for melting or casting with passages for the molten copper enabling a continuous operation to be carried out. When a continuous deoxidizing device is designed including a container having an inlet and outlet for the molten copper and a nozzle mounted in the bottom of the container for blowing a reducing gas, the distance which the bubbles flow up is made sufficiently long, so that the duration of contact between the molten copper and the reducing gas can be prolonged sufficiently to improve the reaction efficiency.

What is claimed is:

1. A method for manufacturing an oxygen-free copper having an oxygen content of less than 3 ppm by weight, comprising: a deoxidizing step of bringing a reducing gas containing hydrogen into contact with a molten copper to react with oxygen in the copper to remove the same, in which said reducing gas is blown into said molten copper; and a dehydrogenation step of exposing said molten copper to an ambient gas comprised of an inert gas with a low hydrogen partial pressure after said deoxidizing step, whereby hydrogen remaining in said molten copper is removed.

2. A method for manufacturing an oxygen-free copper according to claim 1, in which said reducing gas contains a reducing component and an inert component, said reducing component containing 0.5% by volume to 50% by volume of hydrogen.

3. A method for manufacturing an oxygen-free copper according to claim 2, in which said reducing gas contains carbon monoxide as said reducing component.

4. The method for manufacturing an oxygen-free copper according to claim 1, wherein said molten copper is made to flow upwardly after said deoxidizing step.

5. The method for manufacturing an oxygen-free copper according to claim 1, wherein said dehydrogenation step comprises a step of blowing said ambient gas into said molten copper.

6. The method for manufacturing an oxygen-free copper according to claim 1, wherein said dehydrogenation step comprises a step of flowing said molten copper through a trough filled with said ambient gas.

7. The method for manufacturing an oxygen-free copper according to claim 6, wherein said trough comprises at least one stepped portion.

* * * * *